US010436071B2

(12) United States Patent
Rogers et al.

(10) Patent No.: US 10,436,071 B2
(45) Date of Patent: Oct. 8, 2019

(54) BLADE OUTER AIR SEAL HAVING RETENTION SNAP RING

(71) Applicant: United Technologies Corporation, Farmington, CT (US)

(72) Inventors: Daniel S. Rogers, Springvale, ME (US); Jeremy Drake, South Berwick, ME (US); Brian C. McLaughlin, Kennebunk, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 927 days.

(21) Appl. No.: 15/099,755

(22) Filed: Apr. 15, 2016

(65) Prior Publication Data

US 2017/0298776 A1 Oct. 19, 2017

(51) Int. Cl.

| | |
|---|---|
| ***F01D 25/28*** | (2006.01) |
| ***F01D 11/08*** | (2006.01) |
| ***F01D 25/24*** | (2006.01) |

(52) U.S. Cl.

CPC ..... *F01D 25/28* (2013.01); *F01D 11/08* (2013.01); *F01D 25/24* (2013.01); *F01D 25/246* (2013.01); *F05D 2220/32* (2013.01); *F05D 2230/64* (2013.01); *F05D 2230/70* (2013.01); *F05D 2230/72* (2013.01); *F05D 2230/80* (2013.01);

(Continued)

(58) Field of Classification Search

CPC ..... F01D 25/28; F01D 25/246; F01D 25/24; F01D 11/08; F05D 2260/30; F05D 2240/11; F05D 2230/72; F05D 2230/64; F05D 2230/70; F05D 2230/80

See application file for complete search history.

(56) References Cited

U.S. PATENT DOCUMENTS 6,726,446 B2 * 4/2004 Arilla ..... F01D 25/246 415/138
8,365,405 B2 * 2/2013 Minor ..... B23P 6/005 29/402.02

(Continued)

FOREIGN PATENT DOCUMENTS

EP 1079076 A2 2/2001
EP 1225309 A1 7/2002

(Continued)

OTHER PUBLICATIONS

European Search Report, European Application No. 17166781, dated Aug. 14, 2017, European Patent Office; European Search Report 8 pages.

*Primary Examiner* — Jason D Shanske
*Assistant Examiner* — Maxime M Adjagbe
(74) *Attorney, Agent, or Firm* — Cantor Colburn LLP

(57) ABSTRACT

A retention member for a component of a gas turbine engine and methods of using the same are provided. The retention member includes an annular body having a first side, a second side, a first end, and a second end, a retention element configured at the first end of the annular body and on the first side, the retention element configured to releasably engage with an interior surface of a case of the gas turbine engine, and a support element configured at the second end of the annular body, the support element configured to engage with a surface of at least one of a blade outer air seal or a blade outer air seal support.

17 Claims, 7 Drawing Sheets

(52) U.S. Cl.
CPC ..... *F05D 2240/11* (2013.01); *F05D 2260/30* (2013.01)

(56) References Cited

U.S. PATENT DOCUMENTS

| | | | | |
|---|---|---|---|---|
| 8,998,573 | B2 * | 4/2015 | Albers | F01D 11/005 415/139 |
| 9,188,062 | B2 | 11/2015 | Tsutsumi et al. | |
| 2013/0004306 | A1 * | 1/2013 | Albers | F01D 25/246 415/200 |
| 2015/0226124 | A1 | 8/2015 | Tsutsumi et al. | |

FOREIGN PATENT DOCUMENTS

| | | | |
|---|---|---|---|
| EP | 1577506 | A1 | 9/2005 |
| EP | 2971588 | A1 | 1/2016 |

* cited by examiner

BLADE OUTER AIR SEAL HAVING RETENTION SNAP RING

BACKGROUND

The subject matter disclosed herein generally relates to blade outer air seals in gas turbine engines and, more particularly, to retention members for blade outer air seals.

In gas turbine engines, the first stage Blade Outer Air Seals (BOAS) and Blade Outer Air Seal Supports (BOAS Supports) are often attached to hooks on the High Pressure Turbine (HPT) case. These hooks can either face aft or forward and depending on the direction of the hooks, the BOAS and BOAS Support will need to be assembled from the aft side or from the forward side of the gas turbine engine, respectively. It is beneficial to have the BOAS and BOAS Supports FWD removable for engine maintainability.

If the BOAS and BOAS supports, often lower life components, are accessible from the front they can be easily accessible by simply separating the HPT module from a Diffuser module of the gas turbine engine. The alternative is coming from the rear and having to disassemble and remove all components aft of the first stage BOAS and BOAS supports to get to the first stage BOAS and BOAS supports.

During maintenance operations, the gas turbine engine is often oriented forward face down and the HPT case is pulled upward, requiring the BOAS and BOAS supports to be retained and secured such that gravity cannot disengage these elements during disassembly and/or maintenance operations. In order to prevent the first stage BOAS and BOAS Supports from falling out after separating a HPT case flange from a Diffuser module case flange there is often a bolted flange. The bolted flange is either separate from the HPT/Diffuser flange or is included with the flanges thus making it a triple flange. The flange is integral to a component that retains the first stage BOAS and BOAS supports and this component remains with the HPT after separation of the HPT-Diffuser flange. This technique is effective, but it requires a flanged component, and often additional bolts, which adds significant weight, cost, and part count to the gas turbine engine.

SUMMARY

According to one embodiment, a retention member for a component of a gas turbine engine is provided. The retention member includes an annular body having a first side, a second side, a first end, and a second end, a retention element configured at the first end of the annular body and on the first side, the retention element configured to releasably engage with an interior surface of a case of the gas turbine engine, and a support element configured at the second end of the annular body, the support element configured to engage with a surface of at least one of a blade outer air seal or a blade outer air seal support.

In addition to one or more of the features described above, or as an alternative, further embodiments of the retention member may include a seal surface configured to engage with a seal to provide fluid sealing between the annular body and at least one of the interior surface of the case, the blade outer air seal, or the blade outer air seal support.

In addition to one or more of the features described above, or as an alternative, further embodiments of the retention member may include a removal element configured to enable manual removal of the retention member from engagement with the interior surface of the case.

In addition to one or more of the features described above, or as an alternative, further embodiments of the retention member may include that the annular body, the retention element, and the support element are a formed of a unitary body.

In addition to one or more of the features described above, or as an alternative, further embodiments of the retention member may include that the retention element is configured such that, when engaged in a gas turbine engine, the retention element forms an interference fit with a portion of the case of the gas turbine engine.

In addition to one or more of the features described above, or as an alternative, further embodiments of the retention member may include that the retention element is a fastener configured to fasten into the case of the gas turbine engine.

According to another embodiment, a gas turbine engine is provided having a case having case hooks on an interior surface of the case, a blade outer air seal supported by the case hooks, and a retention member. The retention member includes an annular body having a first side, a second side, a first end, and a second end, a retention element configured at the first end of the annular body and on the first side, the retention element configured to releasably engage with the interior surface of the case, and a support element configured at the second end of the annular body, the support element configured to engage with a surface of at least one of the blade outer air seal.

In addition to one or more of the features described above, or as an alternative, further embodiments of the gas turbine engine may include that the retention member further includes a seal surface configured to engage with a seal to provide fluid sealing between the annular body and at least one of the interior surface of the case and the blade outer air seal.

In addition to one or more of the features described above, or as an alternative, further embodiments of the gas turbine engine may include that the retention member further includes a removal element configured to enable manual removal of the retention member from engagement with the interior surface of the case.

In addition to one or more of the features described above, or as an alternative, further embodiments of the gas turbine engine may include that the annular body, the retention element, and the support element are a formed of a unitary body.

In addition to one or more of the features described above, or as an alternative, further embodiments of the gas turbine engine may include that the case hooks are forward facing case hooks.

In addition to one or more of the features described above, or as an alternative, further embodiments of the gas turbine engine may include that the retention element is configured such that, when engaged in the gas turbine engine, the retention element forms an interference fit with a portion of the case of the gas turbine engine.

In addition to one or more of the features described above, or as an alternative, further embodiments of the gas turbine engine may include a blade outer air seal support configured between the case hooks and the blade outer air seal, the blade outer air seal support configured to engage with the case hooks and support the blade outer air seal, the support element configured to engage with at least one of the blade outer air seal or the blade outer air seal support.

In addition to one or more of the features described above, or as an alternative, further embodiments of the gas turbine engine may include a case land on the interior surface of the case, wherein the retention element is configured to engage with the case land in an interference fit.

According to another embodiment, a method of performing a maintenance operation on a gas turbine engine is provided. The method includes removing a first portion of a case of the gas turbine engine, removing components of the gas turbine engine housed within a second portion of the case to expose a blade outer air seal, a blade outer air seal support, and a retention member, the a retention member having an annular body with a first side, a second side, a first end, and a second end, a retention element configured at the first end of the annular body and on the first side, the retention element configured to releasably engage with an interior surface of the second portion of the case, and a support element configured at the second end of the annular body, the support element configured to engage with a surface of at least one of the blade outer air seal or the blade outer air seal support, disengaging the retention member from engagement with the inner surface of the second portion of the case, and performing a maintenance operation on at least one of the blade outer air seal or the blade outer air seal support.

In addition to one or more of the features described above, or as an alternative, further embodiments of the method may include, after performing the maintenance operation, re-engaging the retention member with the interior surface of the second portion of the case to retain at least one of the blade outer air seal and the blade outer air seal support within the second portion of the case.

In addition to one or more of the features described above, or as an alternative, further embodiments of the method may include that the maintenance operation comprises replacing/repairing the blade outer air seal.

In addition to one or more of the features described above, or as an alternative, further embodiments of the method may include that the process is performed from a forward portion of the gas turbine engine and wherein the blade outer air seal support is engaged with forward facing case hooks.

In addition to one or more of the features described above, or as an alternative, further embodiments of the method may include that disengaging the retention member comprises applying force to a removal element of the retention member.

In addition to one or more of the features described above, or as an alternative, further embodiments of the method may include that the retention member is engaged with the interior surface of the second portion of the case by an interference fit.

Technical effects of embodiments of the present disclosure include a retention member for components of a gas turbine engine that is configured to retain or support the components during a maintenance operation performed on the gas turbine engine. Further technical effects include reducing the weight and/or footprint of mechanism for retaining components, such as blade outer air seals, within gas turbine engines.

The foregoing features and elements may be executed or utilized in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
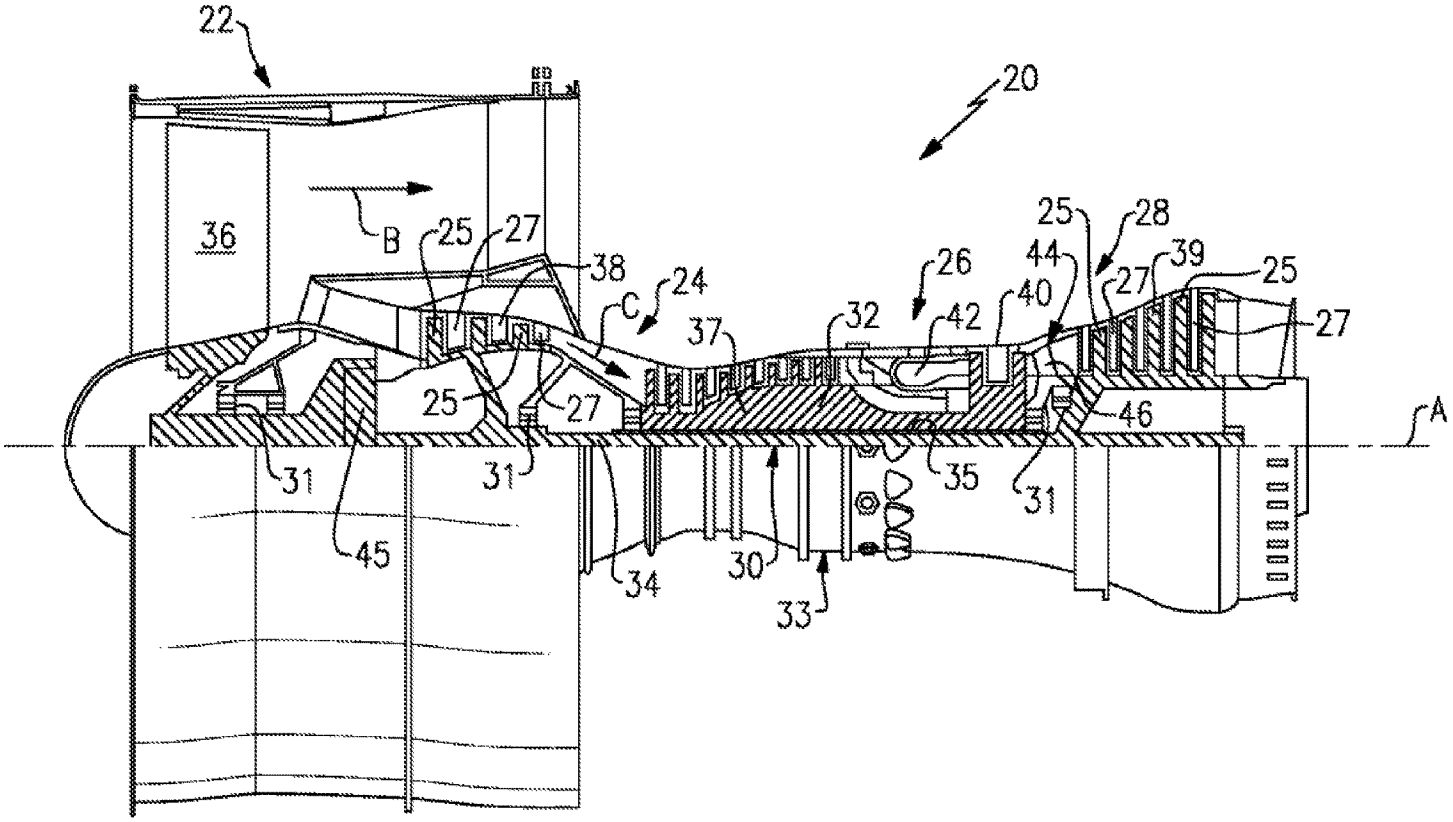
FIG. 1A is a schematic cross-sectional illustration of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the Figure Number to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}\ ^\circ\ \text{R})/(518.7^\circ\ \text{R})]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as airflow bleed ports are discussed below.

Figure 1B:
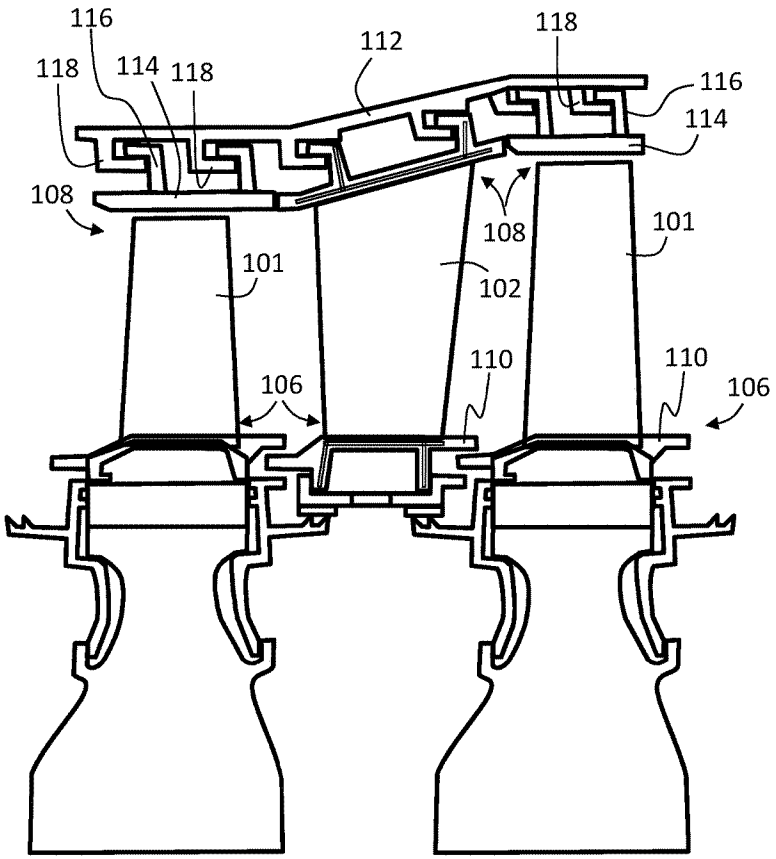
FIG. 1B is a schematic illustration of a turbine that may employ various embodiments disclosed herein.

FIG. 1B is a schematic view of a turbine section that may employ various embodiments disclosed herein. Turbine 100 includes a plurality of airfoils, including, for example, one or more blades 101 and vanes 102. The airfoils 101, 102 may be hollow bodies with internal cavities defining a number of channels or cavities, hereinafter airfoil cavities, formed therein and extending from an inner diameter 106 to an outer diameter 108, or vice-versa. The airfoil cavities may be separated by partitions within the airfoils 101, 102 that may extend either from the inner diameter 106 or the outer diameter 108 of the airfoil 101, 102. The partitions may extend for a portion of the length of the airfoil 101, 102, but may stop or end prior to forming a complete wall within the airfoil 101, 102. Thus, each of the airfoil cavities may be fluidly connected and form a fluid path within the respective airfoil 101, 102. The blades 101 and the vanes may include platforms 110 located proximal to the inner diameter thereof. Located below the platforms 110 may be airflow ports and/or bleed orifices that enable air to bleed from the internal cavities of the airfoils 101, 102. A root of the airfoil may connected to or be part of the platform 110.

The turbine 100 is housed within a case 112, which may have multiple parts (e.g., turbine case, diffuser case, etc.). In various locations, components, such as seals, may be positioned between airfoils 101, 102 and the case 112. For example, as shown in FIG. 1B, blade outer air seals 114 (hereafter "BOAS") are located radially outward from the blades 101. As will be appreciated by those of skill in the art, the BOAS 114 can include BOAS supports (see, e.g., FIG. 2) that are configured to fixedly connect or attach the BOAS 114 to the case 112. As shown in FIG. 1B, the case 112 includes a plurality of hooks 118 that engage with the hooks 116 to secure the BOAS 114 between the case 112 and a tip of the blade 101.

In traditional gas turbine engine configurations, a first stage BOAS is directly aft of a combustor and is exposed to high temperatures expelled therefrom. Accordingly, the first stage BOAS can be a life limiting part of the gas turbine engine and may require replacement more often than surrounding parts (or other parts in the gas turbine engine). Replacing the first stage BOAS can be difficult and/or expensive due to the placement within the gas turbine engine and the steps required to remove the case surrounding the turbine section and providing access to the BOAS. Accordingly, enabling easy or efficient access to BOAS can decrease maintenance costs and/or reduce maintenance times.

Figure 2:
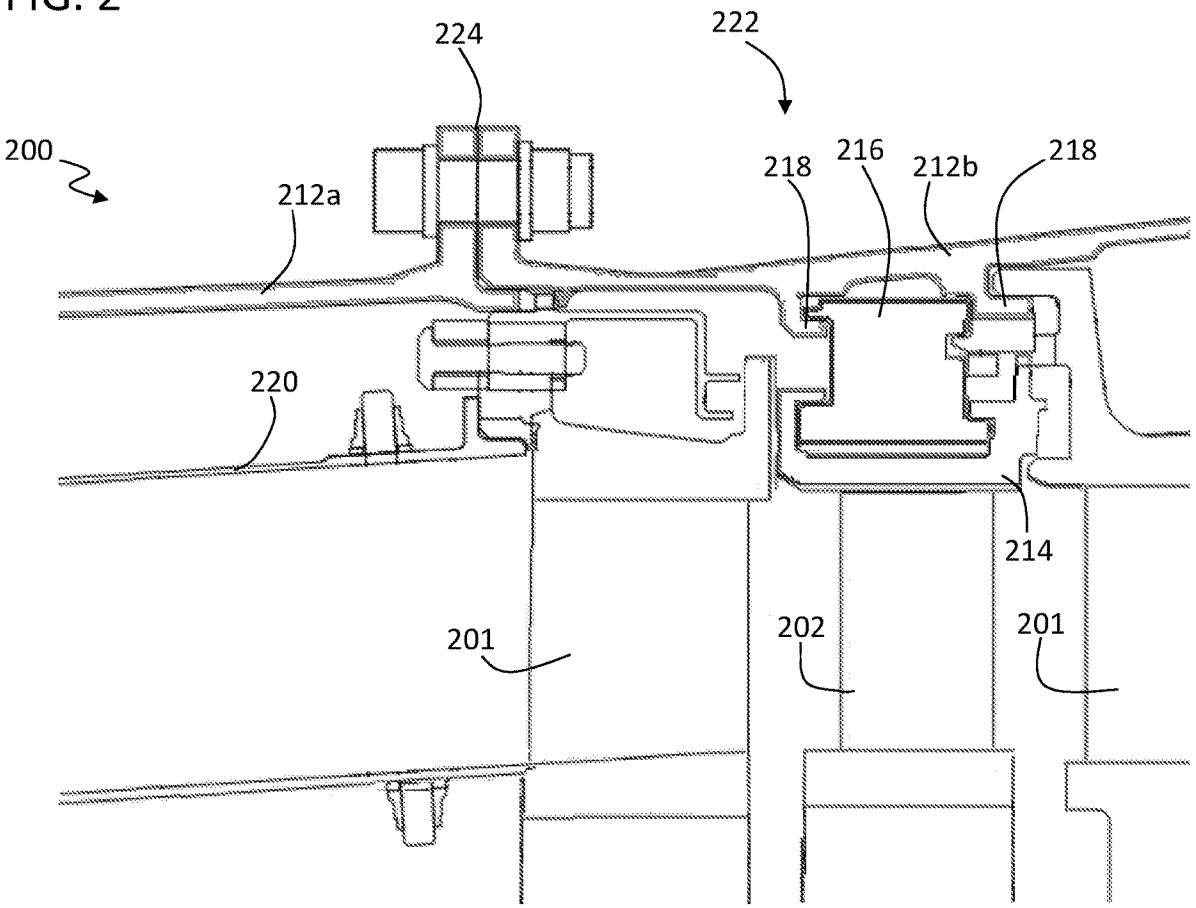
FIG. 2 is a schematic illustration of a portion of a gas turbine engine having a blade outer air seal support engaged with aftward facing case hooks.

For example, turning to FIG. 2, a schematic illustration of a portion of a turbine 200 is shown. The turbine 200 includes a combustor 220 housed within a diffuser case 212*a*. Aft of the combustor 220 is a turbine section 222 such as a high pressure turbine. The turbine section 222 includes a plurality of airfoils 201, 202 housed within a turbine case 212*b*. The diffuser case 212*a* and the turbine case 212*b* are fixedly connected at a joint 224 and form a portion of a case that houses a gas turbine engine.

The turbine case 212*b* includes one or more hooks 218 extending radially inward from an inner surface thereof that are configured to receive components of the turbine 200. For example, one or more case hooks 218 can receive a BOAS support 216 that is located radially outward from a blade 202. The BOAS support 216 supports a BOAS 214 that is located between the BOAS support 216 and a tip of the blade 202. As shown, the case hooks 218 are directed aftward (e.g., to the right in FIG. 2). Because of this, separation at the joint 224 and removal of the diffuser case 212*a* and/or the combustor 220 will not enable access to the BOAS 214 for maintenance, inspection, replacement, etc. Instead, access to a first stage BOAS and/or other first stage components is achieved from an aft-end of the turbine case (e.g., case 212*b*) and may require all components aft of the BOAS 214 to be removed to gain access to the BOAS 214 to enable maintenance, inspection, replacement, etc.

In view of the above, it may be advantageous to have the case hooks face forward, rather than aft, as shown in FIG. 2. For example, with forward facing hooks, during a maintenance operation, the BOAS and/or the BOAS support may disengage from the case hooks, and thus improved access may be advantageous. That is, if the case hooks are forward facing, the BOAS and/or the BOAS support may not be adequately supported and/or retained within the case.

Some solutions to this problem have included bolted supports which require a triple flange (e.g., joint 224 is a double flange). The additional flange would support the BOAS support and/or the BOAS from the forward side. However, increasing the number of flanges is not efficient due to the increased weight imparted by the additional flange. Another solution incorporates a bolt into the BOAS support. By bolting the BOAS, an additional flange is added, and thus the same problem arises. Accordingly, it is desirable to have a support element engage with the BOAS and/or BOAS support such that forward facing case hooks may be used, thus lowering maintenance costs on gas turbine engines.

Figure 3A:
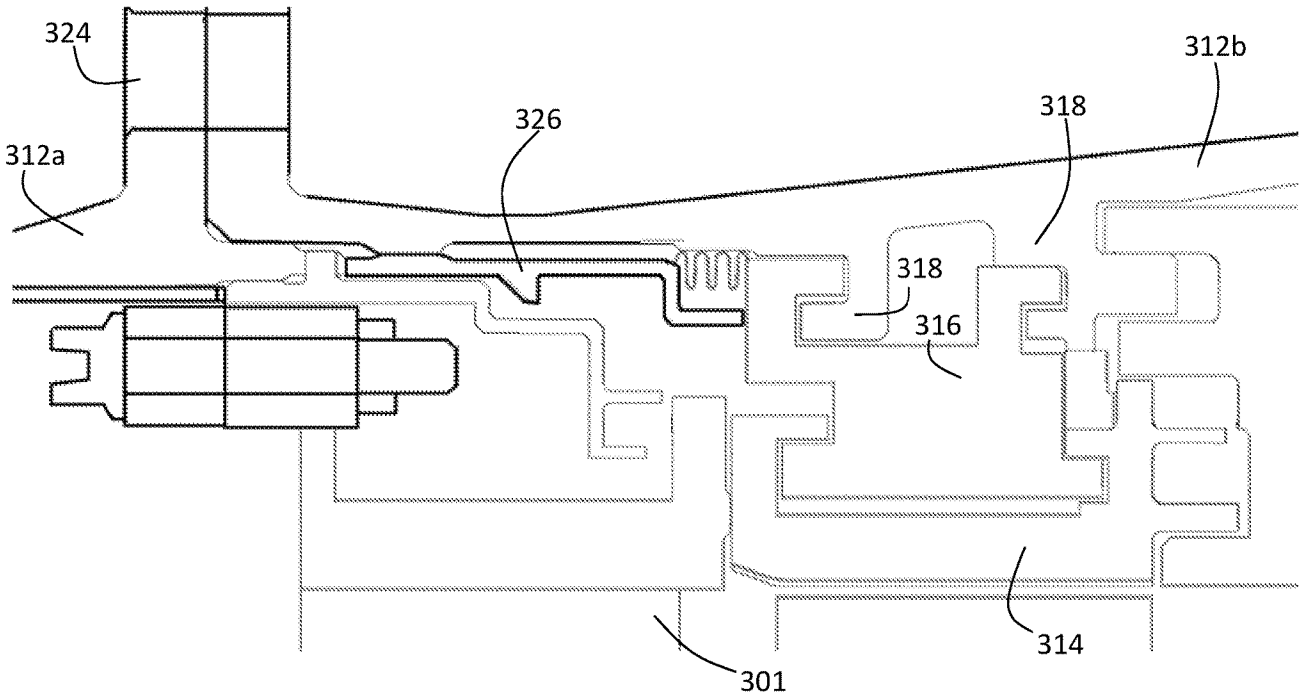
FIG. 3A is a schematic illustration of a portion of a gas turbine engine having a blade outer air seal support engaged with forward facing case hooks and retained by a retention member in accordance with an embodiment of the present disclosure.
Figure 3B:
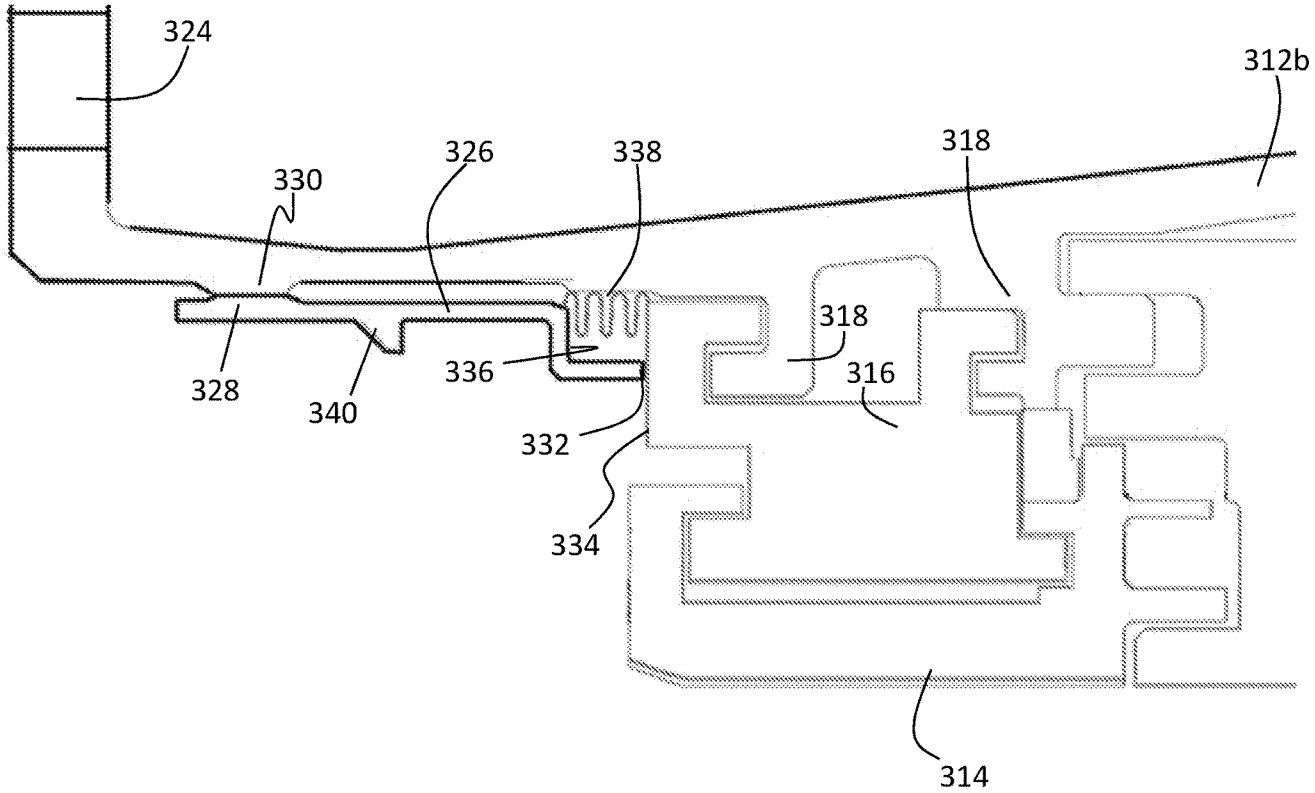
FIG. 3B is a schematic illustration of the gas turbine engine of FIG. 3A in a partial disassembled state.
Figure 3C:
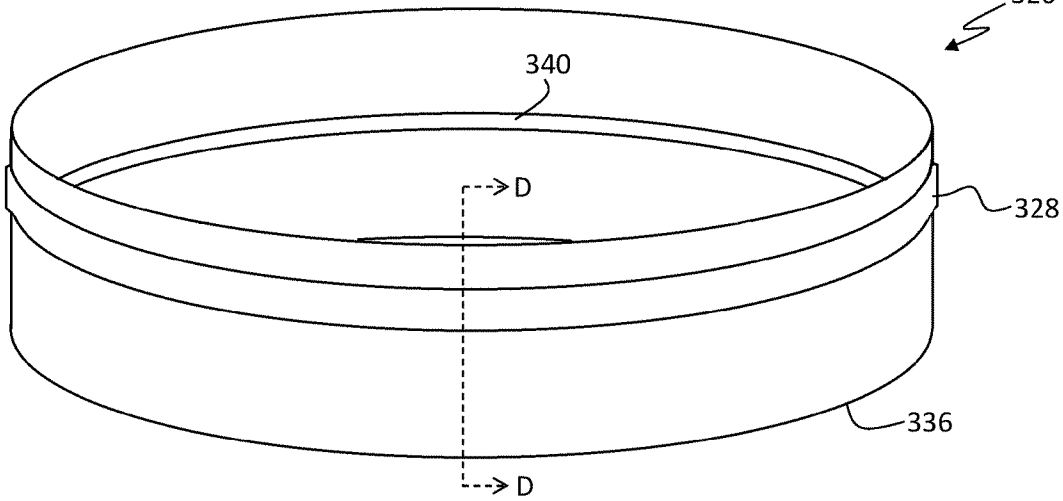
FIG. 3C is an isometric schematic illustration of the retention member of FIG. 3A in accordance with an embodiment of the present disclosure.
Figure 3D:
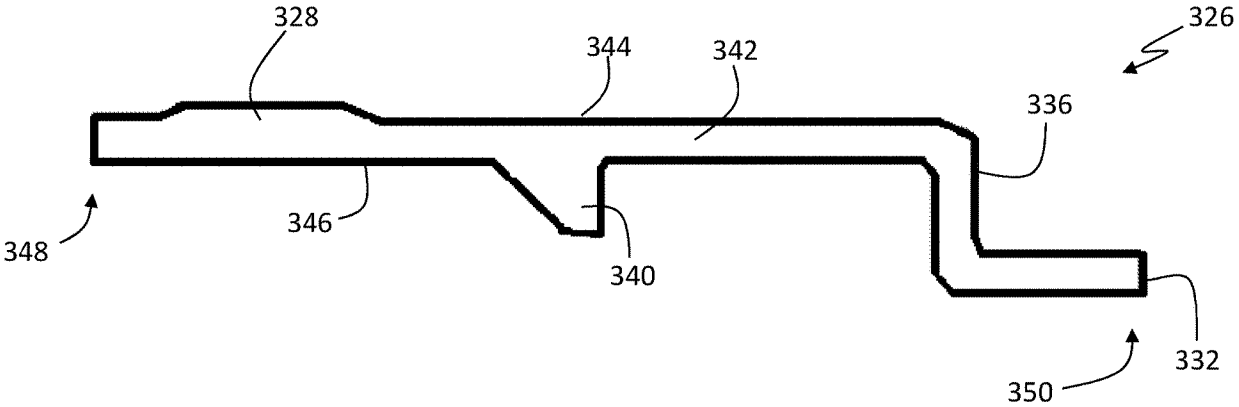
FIG. 3D is a cross-section schematic illustration of the retention member of FIG. 3C as viewed along the line D-D.

Turning now to FIGS. 3A-3D, various schematic illustrations of a BOAS retention member 326 in accordance with a non-limiting embodiment of the present disclosure are shown. FIG. 3A shows a cross-sectional illustration of the BOAS retention member 326 as installed in a turbine 300 of a gas turbine engine. FIG. 3B shows the turbine 300 in a disassembled state wherein the BOAS retention member 326 can be removed from the turbine 300. FIG. 3C is an isometric illustration of the BOAS retention member 326. FIG. 3D is a cross-sectional illustration of the BOAS retention member 326 as viewed along the line D-D in FIG. 3C.

In FIGS. 3A-3B forward is to the left on the page and aftward is to the right on the page. As shown, the BOAS retention member 326 is installed forward of a BOAS support 316 and BOAS 314. In comparison to the embodiments described above, the case hooks 318 are forward facing which is preferable to enable easy maintenance including inspections and/or replacement of the BOAS 314. As shown, the BOAS retention member 326 is configured to support and retain the BOAS support 316 against the case hooks 318 and prevent the BOAS support 316 and/or the BOAS 314 to fall out of the turbine 300 during a maintenance operation. Although shown with the BOAS retention member 326 engaged with the BOAS support 316, those of skill in the art will appreciate that other configurations of the BOAS retention member 326 are possible, including embodiments that engage with the BOAS 314 or both the BOAS 314 and the BOAS support 316.

During a maintenance operation, fasteners are removed from a joint 324 and a diffuser case 312*a* is separated and removed from the turbine case 312*b*. This provides access to the interior of the turbine 300 and an airfoil 301 can be removed (e.g., with removal of diffuser case 312*a*) to grant access to the BOAS 314 and the associated components. Those of skill in the art will appreciate that additional components, parts, and/or features may be required to be removed from the forward side of the BOAS 314 to enable access thereto.

With the forward components removed (e.g., diffuser case 312*a*, airfoil 301, etc.) the BOAS 314 can be accessed, as shown in FIG. 3B. As shown in FIG. 3B, even with the forward components removed, the BOAS retention member 326 engages with and retains the BOAS support 316 such that the BOAS support 316 and the BOAS 314 are held in place. The BOAS retention member 326 fixedly secures the BOAS support 316 in place due to an engagement with a portion of the turbine case 312*b*.

The engagement between the BOAS retention member 326 and the turbine case 312*b* may be by interference fit, snap fit, fastener, or other engagement means or mechanism. For example, as shown in FIGS. 3A-3B, the BOAS retention member 326 includes a retention element 328 that is configured to engage with a case land 330. In the embodiment of FIGS. 3A-3B, the retention element 328 and the case land 330 are configured to form an interference fit. The interference fit is achieved because an exterior diameter of the BOAS retention member 326 is greater than an interior diameter of the turbine case 312*b* at the case land 330. In some embodiments, the retention element of the retention member can be a fastener such as a screw, bolt, snap feature, latch feature, etc.

A support element 332 of the BOAS retention member 326 engages with a forward surface 334 of the BOAS support 316. Further, as shown, the BOAS retention member 326 includes a seal surface 336 that is configured to engage with a seal 338.

To remove the BOAS retention member 326 from engagement with the turbine case 312*b*, the BOAS retention member 326 includes a removal element 340. The removal element 340 is configured to enable a tool or user's hand to pull the BOAS retention member 326 out of engagement with the turbine case 312*b*. Those of skill in the art will appreciate that the removal element 340 is optional, and other means or mechanisms for removing the BOAS retention member 326 from engagement with the turbine case 312*b* are possible without departing from the scope of the present disclosure.

As shown in FIG. 3C, the BOAS retention member 326 is a unitary or continuous annular body formed in the shape of a ring. The BOAS retention member 326 can be manufactured by additive manufacturing, forging, machining, drawing, or other process. The BOAS retention member 326, in some non-limiting embodiments, is formed from a metal or metallic alloy that is selected to provide flexibility in order to enable an interference fit with a case of a gas turbine engine and also to withstand high temperatures during a life of the BOAS retention member.

Turning to FIG. 3D, the BOAS retention member 326 is shown in cross-section and separate from a gas turbine engine. The BOAS retention member 326 is defined by a body 342 having a first, exterior side 344 and a second, interior side 346. The first, exterior side 344 includes the retention element 328 configured to engage with a case of a gas turbine engine. In some embodiments, the retention element 328 is a portion of the BOAS retention member 326 that extends outward from the first side 342. The second, interior side 346 includes the optional removal element 340. As shown, the retention element is located at a first end 348 of the body 342. Further, the body 342 includes the support element 332 at a second end thereof.

Figure 4:
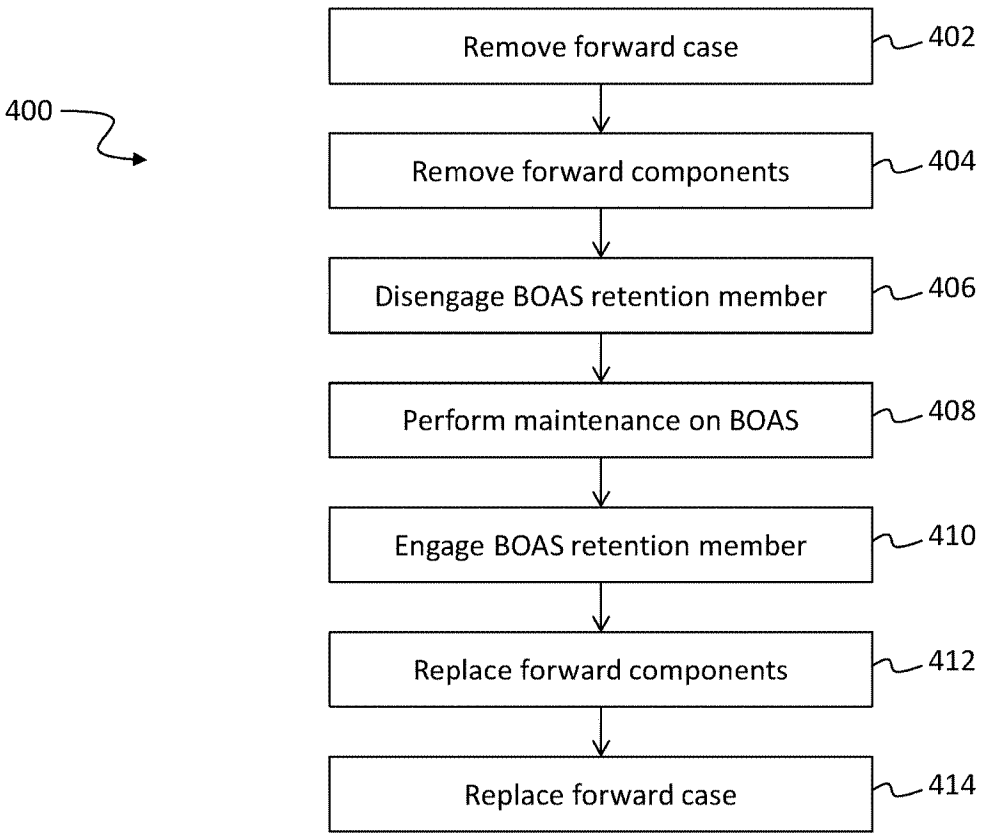
FIG. 4 is a flow process of performing a maintenance operation on a gas turbine engine in accordance with an embodiment of the present disclosure.

Turning now to FIG. 4, a flow process for performing maintenance on a gas turbine engine in accordance with an embodiment of the present disclosure is shown. The flow process 400 can be employed using a BOAS retention member similar to that described above and/or variations thereon. In the embodiment of flow process 400, a BOAS of interest is located near a joint between two sections of case of the gas turbine engine. For simplicity, the orientation will be similar to that shown in FIGS. 3A-4D, wherein case hooks that support a BOAS support are forward facing. However, those of skill in the art will appreciate that flow process 400 can be used for BOAS or other elements of interest that may require support by a retention member.

At block 402, a forward case is removed from the gas turbine engine. The forward case is a section of case that is forward of a location having a BOAS that requires inspection and/or maintenance. With the forward case removed, interior components and parts of the gas turbine engine are exposed and accessible. For example, at block 404, components that are forward of the BOAS of interest are removed from the engine (e.g., compare FIG. 3A and FIG. 3B). Removal of the forward components exposes the BOAS, a BOAS support, and the BOAS retention member (e.g., as described above). At block 406, the BOAS retention member is disengaged from the case, thus enabling access to and removal of the BOAS and/or BOAS support. The disengagement may be achieved by using a tool or even manually pulling on a removal element of the BOAS retention member. In other embodiments, a fastener that joins the BOAS retention member to the case of the gas turbine engine can be removed for disengagement of the BOAS retention member.

At block 408, maintenance is performed on the BOAS and/or BOAS support. For example, maintenance can include inspection of the BOAS and/or BOAS support, and if required, the BOAS and/or BOAS can be removed from the gas turbine engine. The BOAS and/or BOAS support can be replaced during the maintenance operation. After the maintenance operation is completed, the BOAS retention member can be replaced and engaged with a case of the gas turbine engine, as shown at block 410. After the BOAS retention member is secured and supports and retains the BOAS and/or BOAS support, the forward components can be reinstalled into the gas turbine engine, as shown at block 412. Finally, the forward case can be replaced and engaged at a joint, as shown at block 414.

Those of skill in the art will appreciate that the above described process is illustrative and non-limiting and variations thereon are contemplated herein. For example, various of the steps of flow process 400 can be optional, omitted, and/or performed in a different order. Further, additional steps and/or processes can be performed without departing from the scope of the present disclosure. Moreover, although described with respect to forward facing hooks and forward access and removal of the BOAS and/or BOAS support, those of skill in the art will appreciate that the flow process 400 can be performed from an aft side in cases where the part of interest is located closer to an aft flange, and thus provide easy and efficient access to elements/components that are supported and engaged with aftward facing case hooks.

Advantageously, embodiments described herein provide a retention member that enables easy access to a blade outer air seal and/or blade outer air seal support in a gas turbine engine. Further, advantageously, embodiments provided herein enable the use of forward facing or oriented case hooks on case elements of a gas turbine engine such that easy removal, replacement, and/or inspection of BOAS is enabled. Further, embodiments provided herein can provide significant savings in weight, cost, and/or part count by eliminating the need for additional components to support a BOAS and/or BOAS support. For example, flange bolt holes can be structurally limiting features because they introduce stress concentrations, and embodiments provided herein eliminate such bolt holes thus improving fatigue life in turbine cases, diffuser cases, BOAS supports, and other components. Further, embodiments provided herein have a relatively simple geometry, as compared to configurations having additional flanges, bolts, etc.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although an aero or aircraft engine application is shown and described above, those of skill in the art will appreciate that airfoil configurations as described herein may be applied to industrial applications and/or industrial gas turbine engines, land based or otherwise. Further, although shown and described herein with respect forward facing case hooks, those of skill in the art will appreciate that aftward facing case hooks and appropriately configured BOAS and/or BOAS supports can employ embodiments of the present disclosure. Moreover, although shown and described with respect to a particular BOAS, those of skill in the art that retention members as shown and described herein may be used to retain any component within a gas turbine engine, including but not limited to, compressor BOAS and/or compressor BOAS supports.

Accordingly, the present disclosure is not to be seen as limited by the foregoing description, but is only limited by the scope of the appended claims.

What is claimed is:

1. A retention member for a component of a gas turbine engine comprising:

an annular body having a first side, a second side, a first end, and a second end;

a retention element configured at the first end of the annular body and on the first side, the retention element configured to releasably engage with an interior surface of a case of the gas turbine engine; and a support element configured at the second end of the annular body, the support element configured to engage with a surface of at least one of a blade outer air seal or a blade outer air seal support, wherein the retention element is configured such that, when engaged in the gas turbine engine, the retention element forms an interference fit with a portion of the case of the gas turbine engine, wherein an exterior diameter of the annular body at the retention element is greater than an interior diameter of the interior surface of the case to form the interference fit.

2. The retention member of claim 1, further comprising a seal surface configured to engage with a seal to provide fluid sealing between the annular body and at least one of the interior surface of the case, the blade outer air seal, or the blade outer air seal support.

3. The retention member of claim 1, further comprising a removal element configured to enable manual removal of the retention member from engagement with the interior surface of the case.

4. The retention member of claim 1, wherein the annular body, the retention element, and the support element are a formed of a unitary body.

5. The retention member of claim 1, wherein the retention element is a fastener configured to fasten into the case of the gas turbine engine.

6. A gas turbine engine comprising:

a case having case hooks on an interior surface of the case;

a blade outer air seal supported by the case hooks; and a retention member comprising:

an annular body having a first side, a second side, a first end, and a second end;

a retention element configured at the first end of the annular body and on the first side, the retention element configured to releasably engage with the interior surface of the case; and a support element configured at the second end of the annular body, the support element configured to engage with a surface of the blade outer air seal, wherein the retention element is configured such that, when engaged in the gas turbine engine, the retention element forms an interference fit with a portion of the case of the gas turbine engine, wherein an exterior diameter of the annular body at the retention element is greater than an interior diameter of the interior surface of the case to form the interference fit.

7. The gas turbine engine of claim 6, the retention member further comprising a seal surface configured to engage with a seal to provide fluid sealing between the annular body and at least one of the interior surface of the case and the blade outer air seal.

8. The gas turbine engine of claim 6, the retention member further comprising a removal element configured to enable manual removal of the retention member from engagement with the interior surface of the case.

9. The gas turbine engine of claim 6, wherein the annular body, the retention element, and the support element are a formed of a unitary body.

10. The gas turbine engine of claim 6, wherein the case hooks are forward facing case hooks.

11. The gas turbine engine of claim 6, further comprising a blade outer air seal support configured between the case hooks and the blade outer air seal, the blade outer air seal support configured to engage with the case hooks and support the blade outer air seal, the support element configured to engage with at least one of the blade outer air seal or the blade outer air seal support.

12. The gas turbine engine of claim 6, further comprising a case land on the interior surface of the case, wherein the retention element is configured to engage with the case land in an interference fit.

13. A method of performing a maintenance operation on a gas turbine engine, the method comprising:

removing a first portion of a case of the gas turbine engine;

removing components of the gas turbine engine housed within a second portion of the case to expose a blade outer air seal, a blade outer air seal support, and a retention member, the retention member having an annular body with a first side, a second side, a first end, and a second end, a retention element configured at the first end of the annular body and on the first side, the retention element configured to releasably engage with an interior surface of the second portion of the case with an interference fit, and a support element configured at the second end of the annular body, the support element configured to engage with a surface of at least one of the blade outer air seal or the blade outer air seal support, wherein an exterior diameter of the annular body at the retention element is greater than an interior diameter of the interior surface of the case to form the interference fit;

disengaging the interference fit of the retention member from engagement with the inner surface of the second portion of the case; and performing a maintenance operation on at least one of the blade outer air seal or the blade outer air seal support.

14. The method of claim 13, further comprising, after performing the maintenance operation, re-engaging the retention member with the interior surface of the second portion of the case to retain at least one of the blade outer air seal and the blade outer air seal support within the second portion of the case.

15. The method of claim 1, wherein the maintenance operation comprises replacing/repairing the blade outer air seal.

16. The method of claim 13, wherein the method is performed from a forward portion of the gas turbine engine and wherein the blade outer air seal support is engaged with forward facing case hooks.

17. The method of claim 13, wherein disengaging the retention member comprises applying force to a removal element of the retention member.

* * * * *